US011920416B2

(12) United States Patent
Cheng et al.

(10) Patent No.: US 11,920,416 B2
(45) Date of Patent: Mar. 5, 2024

(54) METAL-TO-METAL ANNULUS PACKOFF RETRIEVAL TOOL SYSTEM AND METHOD

(71) Applicant: Baker Hughes Oilfield Operations LLC, Houston, TX (US)

(72) Inventors: Samuel Cheng, Katy, TX (US); Eugene Borak, Houston, TX (US); Gajanan Hegde, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/552,949

(22) Filed: Dec. 16, 2021

(65) Prior Publication Data

US 2022/0195823 A1 Jun. 23, 2022

Related U.S. Application Data

(60) Provisional application No. 63/127,271, filed on Dec. 18, 2020.

(51) Int. Cl.
*E21B 23/04* (2006.01)

(52) U.S. Cl.
CPC ..... *E21B 23/042* (2020.05)

(58) Field of Classification Search
CPC ..... E21B 23/04; E21B 23/042; E21B 33/04
See application file for complete search history.

(56) References Cited

U.S. PATENT DOCUMENTS 3,179,448 A 4/1965 Jones
3,350,130 A * 10/1967 Ahlstone ..... E21B 17/1007 294/93
3,468,559 A * 9/1969 Ahlstone ..... E21B 33/043 166/348
3,693,714 A * 9/1972 Baugh ..... E21B 33/047 166/348
4,003,434 A 1/1977 Garrett
(Continued)

FOREIGN PATENT DOCUMENTS

EP 0 378 040 7/1990
EP 0 523 301 1/1993
(Continued)

OTHER PUBLICATIONS

International Search Report and Written Opinion dated Apr. 11, 2022 in corresponding PCT Application No. PCT/US2021/073006.
(Continued)

*Primary Examiner* — Shane Bomar
(74) *Attorney, Agent, or Firm* — Hogan Lovells US LLP

(57) ABSTRACT

A wellbore system includes an adapter configured to couple to a downhole component. The wellbore system also includes a retrieval tubular, having a bore extending therethrough. The wellbore system further includes a piston assembly coupled to the retrieval tubular, wherein the bore is in fluid communication with a cavity of the piston assembly. The wellbore system includes a stem configured to couple to a casing section, the casing section being supported by a hanger. The wellbore system also includes a sleeve forming at least a portion of the piston assembly, the sleeve configured to couple to the adapter such that, responsive to a force applied by the piston at the casing section, the sleeve applies an upward force to the adapter.

19 Claims, 8 Drawing Sheets

(56) References Cited

U.S. PATENT DOCUMENTS

| | | | | |
|---|---|---|---|---|
| 4,736,799 | A * | 4/1988 | Ahlstone | E21B 33/047 166/182 |
| 4,880,061 | A * | 11/1989 | Ahlstone | E21B 47/18 166/182 |
| 4,979,566 | A | 12/1990 | Hosie | |
| 6,095,242 | A | 8/2000 | Lequang et al. | |
| 8,955,604 | B2 * | 2/2015 | Gette | E21B 34/142 166/212 |
| 9,133,679 | B2 | 9/2015 | Robottom | |
| 10,196,872 | B2 | 2/2019 | Kauffmann | |
| 10,480,273 | B2 | 11/2019 | Chirko | |
| 2003/0042027 | A1 | 3/2003 | Lang | |
| 2004/0129429 | A1 | 7/2004 | Dallas | |
| 2004/0251031 | A1 | 12/2004 | Reimert | |
| 2011/0240306 | A1 | 10/2011 | Neto | |
| 2012/0305269 | A1 | 12/2012 | Bories | |
| 2013/0098635 | A1 * | 4/2013 | Gette | E21B 34/142 166/318 |
| 2017/0191324 | A1 | 7/2017 | Nguyen | |
| 2019/0024472 | A1 | 1/2019 | Lugo | |
| 2022/0195826 | A1 * | 6/2022 | Cheng | E21B 33/0422 |
| 2023/0132558 | A1 * | 5/2023 | Cheng | E21B 23/03 166/379 |

FOREIGN PATENT DOCUMENTS

| | | |
|---|---|---|
| EP | 3 342 975 | 7/2018 |
| WO | 2013/158030 A1 | 10/2013 |
| WO | 2018/118653 | 6/2018 |

OTHER PUBLICATIONS

International Search Report and Written Opinion dated Apr. 11, 2022 in corresponding PCT Application No. PCT/US2021/073008.
Office Action dated Jul. 13, 2022 in related U.S. Appl. No. 17/552,962.
Final Office Action dated Dec. 22, 2022 in related U.S. Appl. No. 17/552,962.
Non-Final Office Action dated Apr. 3, 2023 in related U.S. Appl. No. 17/552,962.
Final Office Action dated Sep. 7, 2023 in related U.S. Appl. No. 17/552,962.

* cited by examiner

METAL-TO-METAL ANNULUS PACKOFF RETRIEVAL TOOL SYSTEM AND METHOD

CROSS-REFERENCE TO RELATED APPLICATIONS

This application claims priority to U.S. Provisional Application Ser. No. 63/127,271, filed Dec. 18, 2020, entitled "EMERGENCY METAL-TO-METAL ANNULUS PACKOFF RETRIEVAL TOOL SYSTEM AND METHOD," which is hereby incorporated herein in its entirety for all purposes.

BACKGROUND

1. Field of Disclosure

This disclosure relates in general to oil and gas tools, and in particular, to systems and methods for retrieval devices.

2. Description of the Prior Art

In exploration and production of formation minerals, such as oil and gas, wellbores may be drilled into an underground formation. The wellbores may include various drilling, completion, or exploration components, such as hangers or sealing systems that may be arranged in a downhole portion or at a surface location. Often, these components may be hand installed at a surface location by operators and then lowered into the wellbore. Moreover, various devices may withstand large pressures, and as a result, removal of these devices without removing uphole components is challenging.

SUMMARY

Applicants recognized the problems noted above herein and conceived and developed embodiments of systems and methods, according to the present disclosure, for wellbore operations.

In an embodiment, a wellbore system includes an adapter configured to couple to a downhole component. The wellbore system also includes a retrieval tubular, having a bore extending therethrough. The wellbore system further includes a piston assembly coupled to the retrieval tubular, wherein the bore is in fluid communication with a cavity of the piston assembly. The wellbore system includes a stem configured to couple to a casing section, the casing section being supported by a hanger. The wellbore system also includes a sleeve forming at least a portion of the piston assembly, the sleeve configured to couple to the adapter such that, responsive to a force applied by the piston at the casing section, the sleeve applies an upward force to the adapter.

In an embodiment, a retrieval assembly includes a retrieval tubular having a stem at an end, a bore extending through at least a portion of the retrieval tubular forming a flow path to a location external of the bore. The retrieval assembly also includes a piston assembly, the piston assembly having a sleeve and a cap that form, at least in part, a cavity, the sleeve adapted to couple to a retrieval adapter associated with a downhole component, wherein a piston head is movable within the cavity responsive to a fluid pressure introduced via the flow path. The flow path directs the fluid pressure to an uphole side of the piston head such that the stem is driven in a downhole direction to engage a casing section, the stem applying a force at the casing section such that the sleeve is driven in an uphole direction to drive movement of the retrieval adapter in the uphole direction to disengage at least a portion of the downhole component.

In an embodiment, a method for removing a downhole component includes coupling, to a downhole component, an adapter. The method also includes coupling, to the adapter, a sleeve of a removal tool. The method further includes coupling, to a casing section, a stem of the removal tool. The method also includes generating a downward force at the casing section. The method further includes responsive to the downward force, deactivating the downhole component.

BRIEF DESCRIPTION OF THE DRAWINGS

The present technology will be better understood on reading the following detailed description of non-limiting embodiments thereof, and on examining the accompanying drawings, in which.

DETAILED DESCRIPTION

Figure 1:
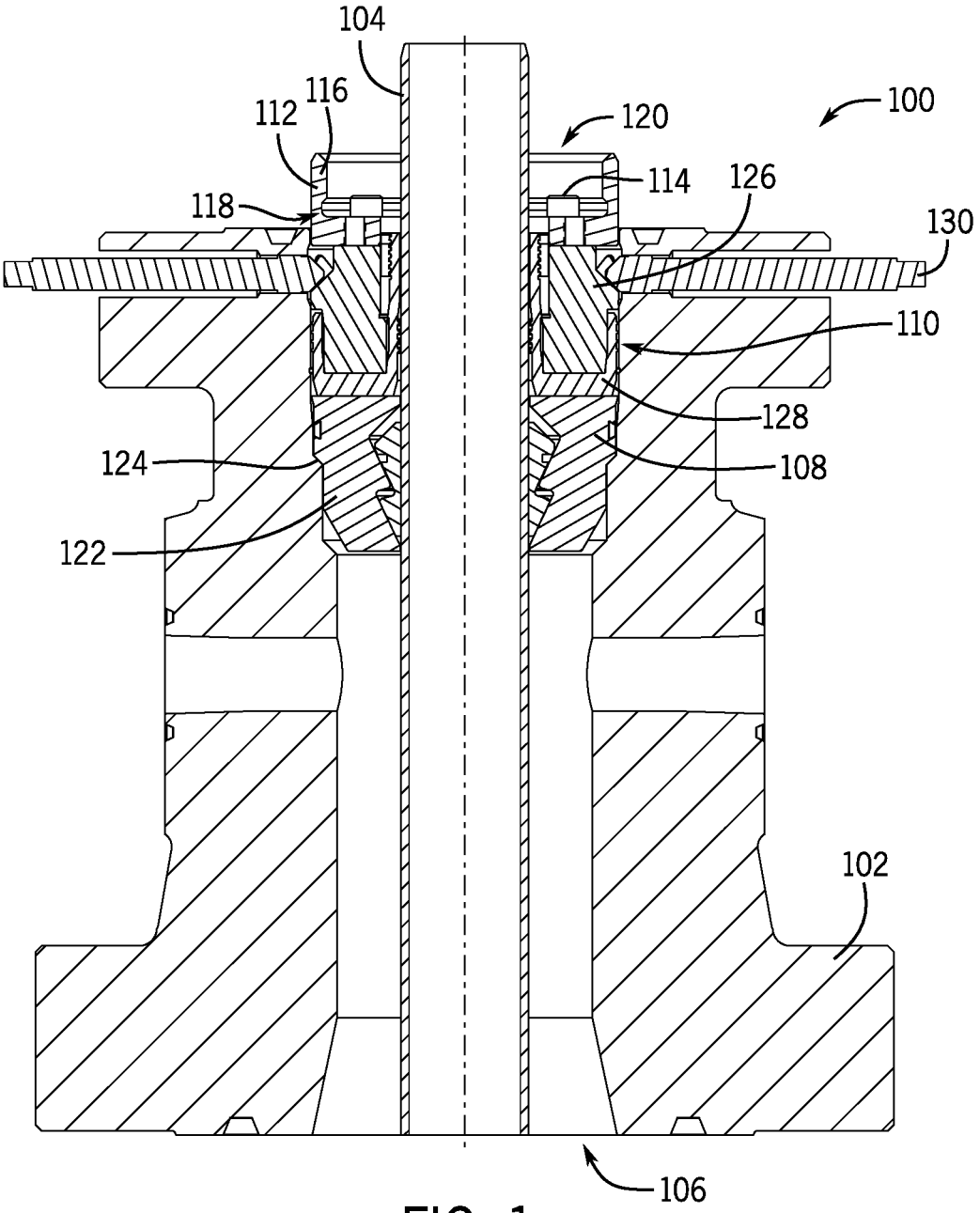
FIG. 1 is a cross-sectional view of an embodiment of a wellbore system, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present disclosure are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure are directed toward systems and methods for retrieval tools, which may include a hydraulic retrieval tool, and in various embodiments, may be utilized to remove a seal or packoff. In at least one embodiment, a retrieval tool enables removal of downhole components, such as an emergency completions metal-to-metal annulus packoff, by way of example only. It is advantageous for operators to install and remove various devices through existing drilling equipment (e.g., blow out preventers), because it minimizes the amount of time required to remove and reinstall drilling equipment to expose the wellhead. In various embodiments, removal is enabled through a workover/drilling package, such as a blowout preventer. Additionally, as indicated above, embodiments, enable safe removal without a tool interface/reaction point above, which is typically in the form of a riser or spool. Accordingly, embodiments are directed toward systems and methods that may reduce rig time by removing or reducing additional equipment added (e.g., via manufacturing or installation) between the workover package and the wellhead.

Embodiments of the present disclosure are directed toward systems and methods to utilize a casing stub (also known as a cut-off) as a reactive point. A reactive point may refer to a location where a reactive force is provided in response to an applied force. Conventional running tools react off of a hanger body or a feature in the wellhead/spool and not from a casing stub (e.g., a cut casing stub). However, for emergency completions, as an example, a slip hanger or other hanging device may not have points to react off of (e.g., to use as a point to apply a pressure), because a seal may cover the hanger body. Furthermore, running a tooling spool/double studded adapter (DSA) above the wellhead may require additional equipment manufacturing and be expensive due to running and rig time. Accordingly, embodiments of the present disclosure are directed toward systems and methods that enable, by way of example, an emergency completion annulus packoff to be retrieved using the casing stub, that is held from below by slip segments. Systems and methods may be utilized to lock to the packoff using one or more mechanical interfaces. Pressure may then be applied to a tool that drives the tool reaction point against the casing stub so that the seal can be removed. As a result, there are not additional spools/DSA with reaction features added, such as extra lock ring/dog grooves/threads. Furthermore, embodiments enable use with emergency completions.

FIG. 1 is a cross-sectional view of an embodiment of a wellbore system 100 including a tubing spool 102 with a casing section 104 extending through a bore 106 of the tubing spool 102. Various embodiments may refer to an emergency completion, but it should be appreciated that systems and methods of the present disclosure may be used with a variety of different wellbore configurations in different stages. In this example, a slip hanger 108 is arranged within the tubing spool 102 to support the casing section 104. A seal 110 (e.g., seal assembly) is positioned above (e.g., axially higher, uphole, etc.) the slip hanger 108, and in various embodiments, may cover at least a portion of the slip hanger 108. That is the seal 110 may block contact with the slip hanger 108 from an uphole location. In other words, the seal 110 may block contact from an uphole location with the slip hanger 108. In this example, the seal 110 may be held in place by one or more fasteners 130 that extend from an exterior portion of the tubing spool. It should be appreciated that these fasteners 130 may be removed to facilitate removal of components, as will be described herein. Furthermore, fasteners 130 are provided as one example and various embodiments may also include other types of locking features, such as lock rings, dogs, and the like.

In this example, a seal retrieval adapter 112 is coupled to the seal 110, for example, via one or more fasteners 114 (e.g., coupling fasteners). It should be appreciated that a variety of features may be utilized to couple the seal retrieval adapter 112 to the seal 110 and fasteners are provided as just one example. For example, various clamps, threads, j-slots, fingers, dogs, and the like may also be utilized. The illustrated seal retrieval adapter 112 may be installed as the seal 110 is installed within the wellbore. That is, the seal retrieval adapter 112 may be coupled to the seal 110 (or to components of the seal assembly, such as an energizing ring) uphole and then run into the wellbore along with the seal 110. Moreover, in various embodiments, the seal retrieval adapter 112 may be separately installed, for example, while the seal 110 is positioned within the wellbore.

In this example, the seal retrieval adapter 112 includes walls 116 and a groove 118, which as described below, may be utilized to facilitate attachment to the seal retrieval adapter 112. It should be appreciated that the walls 116 may also include threads, which may couple with mating threads, in various embodiments. The illustrated walls 116 provide an interior annulus 120 that provides space between the walls 116 and the casing section 104.

In this example, the slip hanger 108 includes slips 122 that are arranged within the bore 106. In this example, the slips 122 are position against one or more activation surfaces 124 (e.g., load shoulders, primary load shoulders, secondary load shoulders, etc.), which may facilitate in activating the slips 122 and/or preventing disengagement of the slips. As shown, the individual sips 122 are driven radially inward from a bore wall to grip the casing section 104.

The illustrated seal assembly 110 is shown as a U-shaped seal that includes an energizing ring 126 positioned between respective legs of a sealing element 128. The inner and outer legs are driven radially inward/outward from the energizing ring 126 to bear against both the casing section 104 and the tubing spool 102, respectively, thereby blocking pressure from a downhole location. In this example, seal fasteners 130 extend into the bore 106 to secure or otherwise engage the energizing ring 126. It should be appreciated that such an arrangement is for illustrative purposes only and that, in other embodiments, seal fasteners 130 may be omitted or positioned within the bore 106 such that external intervention is not utilized to set the seal element 128.

Figure 2:
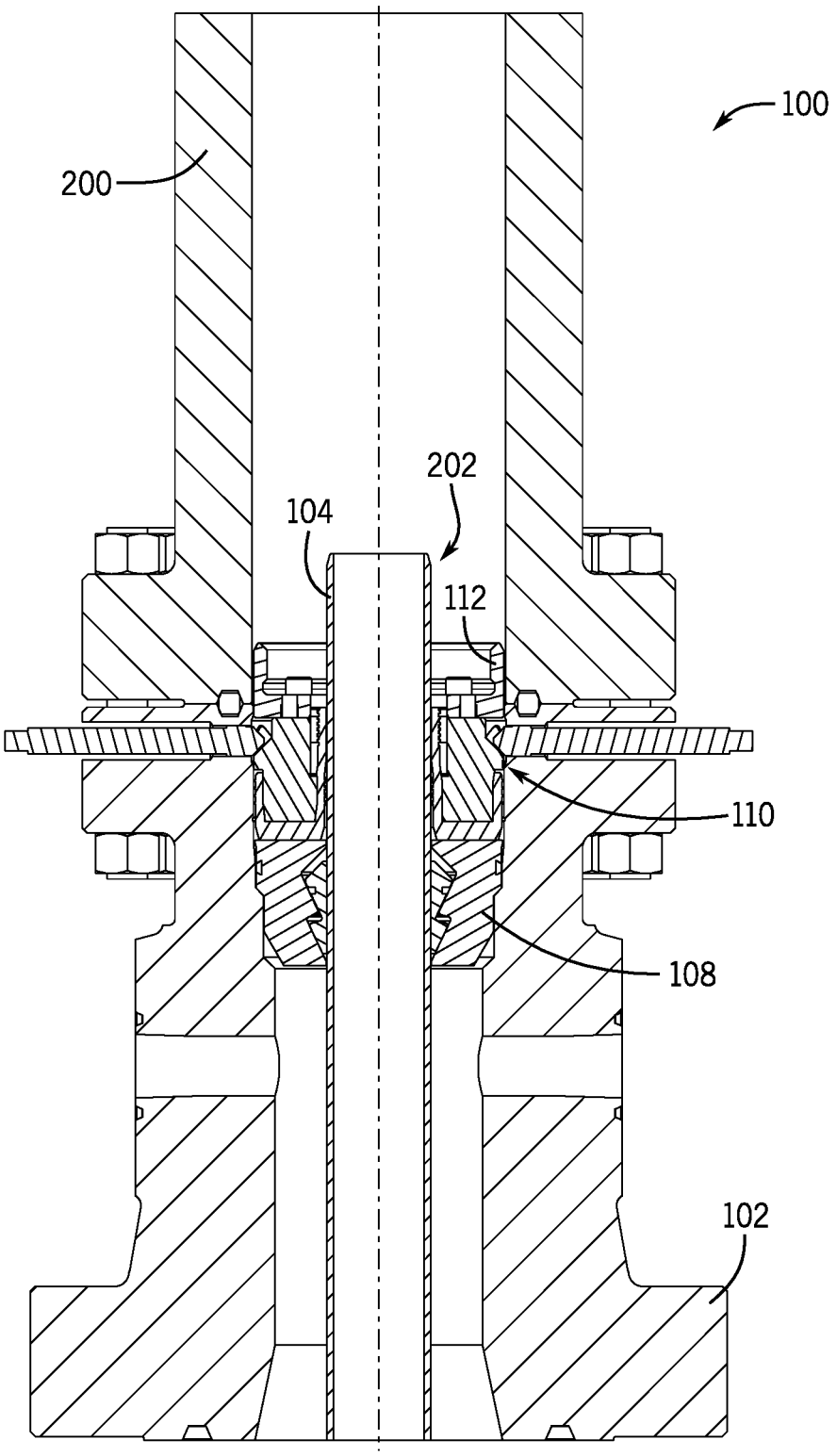
FIG. 2 is a cross-sectional view of an embodiment of a wellbore system, in accordance with embodiments of the present disclosure.

FIG. 2 is a cross-sectional view of an embodiment of the wellbore system 100 where a drilling/workover component 200 (e.g., a tubular component) is coupled to the tubing spool 102. It should be appreciated that the drilling/workover component 200 may be a riser, a blowout preventer (BOP), or the like. Furthermore, the drilling/workover component 200 may be an intermediate component that is further coupled to or forms at least a portion of a riser, BOP, or the like. In various embodiments, the drilling/workover component 200 may be utilized for pressure control or continued wellbore operations and may include additional features, which are omitted for clarity with the following discussion.

In this example, the casing section 104 is arranged within the tubing spool 102 and supported by the slip hanger 108. Moreover, the seal 110 is secured into position and further includes the seal retrieval adapter 112 coupled above (e.g., axially higher, closer to the entrance, uphole, etc.). As shown, a stub end 202 of the casing section 104 extends axially higher uphole than the slip hanger 108 and the seal retrieval adapter 112 such that at least a portion of the stub end 202 is circumferentially surrounded by at least a portion of the tubular component 200. It should be appreciated that various embodiments may include configurations where the stub end 202 is substantially flush with or axially lower than the seal retrieval adapter 112.

Figure 3:
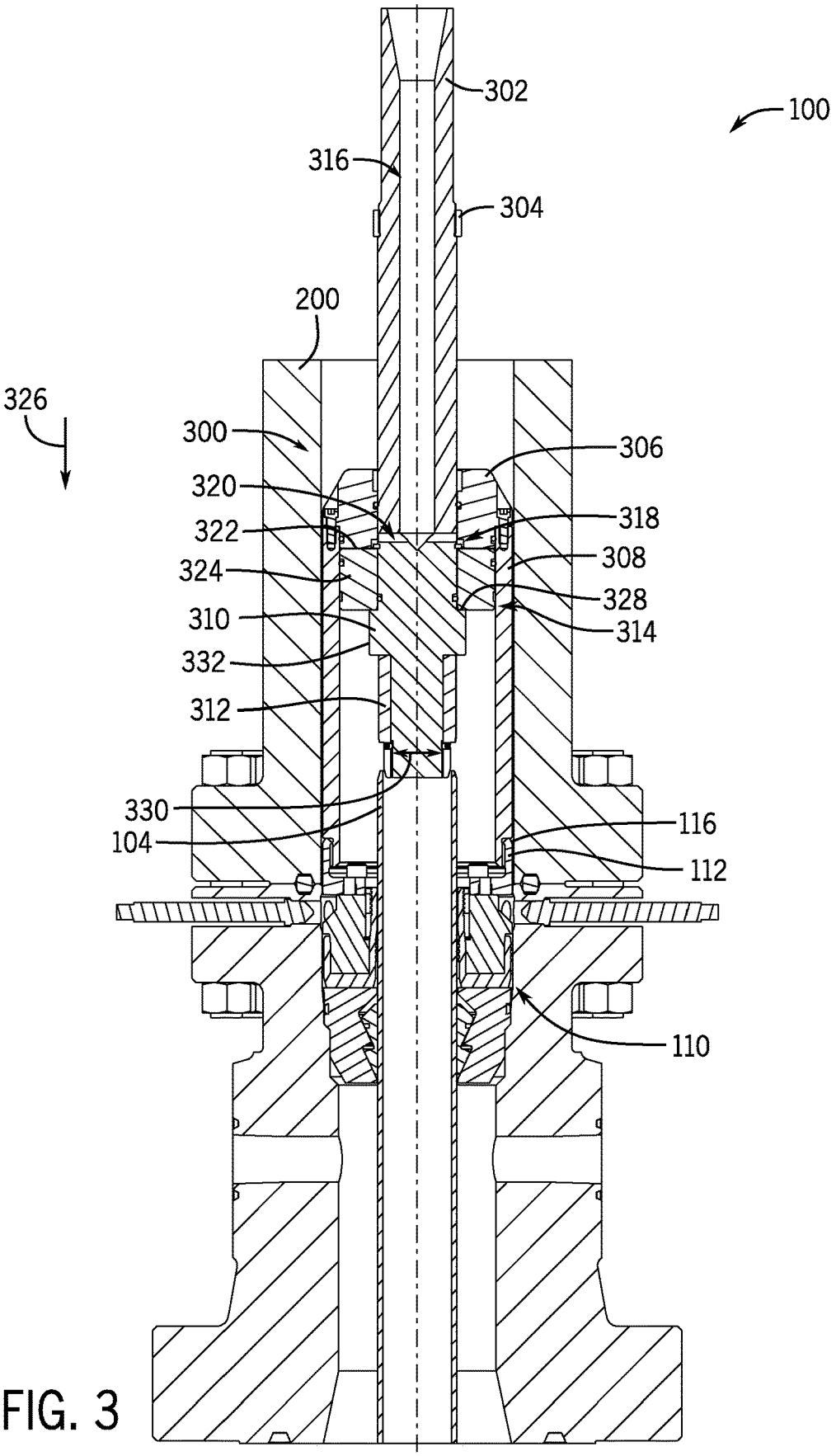
FIG. 3 is a cross-sectional view of an embodiment of a wellbore system, in accordance with embodiments of the present disclosure.

FIG. 3 is cross-sectional view of an embodiment of a seal retrieval tool 300 (e.g., retrieval tool assembly) extending into the drilling/workover component 200 to engage the seal 110. In this example, the seal retrieval tool 300 includes retrieval tubular 302, a stop nut 304, a sleeve cap 306, a sleeve 308, a stem 310, a stem adapter 312, and a piston 314 (e.g., piston assembly). As will be described below, in various embodiments, the stem 310 may be utilized to engage the casing section 104 and transmit a force, applied via fluid acting on the piston 314, to drive the sleeve 308 in an uphole direction (e.g., axially upward), thereby lifting the seal retrieval adapter 112 and seal 110.

In at least one embodiment, the retrieval tubular 302 includes a bore 316 to facilitate a flow of fluid into a cavity 318 associated with the piston 314. As illustrated, the bore 316 includes a flow path 320 that extends proximate the sleeve cap 306 to apply a fluid pressure to an uphole side 322 of a piston head 324. That is, the pressure is applied to the uphole side 322 opposite a side closer to the seal assembly 110. As will be described below, the piston head 324 may be driven in a downward direction 326 (e.g., toward the seal assembly 110) and into the stem 310, which includes a shoulder 328 that may receive forces from the piston head 324. This force, at least in part, may facilitate make up between the stem 310 and casing section 104, for example via the stem adapter 312. As will be appreciated, the stem adapter 312 may be coupled to the stem 310 to adjust an outer diameter 330 to facilitate coupling to a variety of potential different sizes of casing sections 104. Accordingly, the stem adapter 312 may be removable from the stem 310. As noted above, coupling the stem 310 to the casing section 104 creates a reaction point for further fluid pressure to drive removal of the seal 110.

In this example, the piston head 324 is positioned circumferentially about the stem 310 such that axial movement of the piston head 324 in the downward direction 326 along the stem 320 is blocked via an increased diameter portion 332 (e.g., extending portion). That is, downward forces applied to the piston head 324 (e.g., a force along the uphole side 322) are translated to the stem 310 via contact between the piston head 324 and the increased diameter portion 332. It should be appreciated that, in various embodiments, different configurations may be utilized. For example, the piston head 324 may be integrally formed with the stem 310.

Further shown in FIG. 3 is the cap 306 coupled to the sleeve 308. In this example, fasteners are utilized to couple the cap 306 to the sleeve 308, but it should be appreciated that this part may be one piece or various couplings may be utilized, such as threaded fittings, interference fits, dogs, j-slots, welding and the like. The cap is coupled to the retrieval tubular 302, and in various embodiments, includes a j-slot or other coupling to facilitate rotation of the tool assembly 300 over a predetermined range. The illustrated sleeve 308 extends in a downhole direction to engage the seal retrieval adapter 112. That is, the walls 116 may include one or more overhangs or shoulders that facilitate coupling between the sleeve 308 and the seal retrieval adapter 112, however, other fasteners may also be utilized such as threads or the like. In certain embodiments, one or more features may block upward movement of the sleeve 308 relative to the seal retrieval adapter 112 after the sleeve 308 is set, thereby enabling the sleeve 308 to apply force to remove the seal retrieval adapter 112, and consequently, the seal 110.

In operation, a running tool may run the retrieval tool assembly 300 into the wellbore and an interface between the retrieval tubular 302 and the cap 306, such as a j-slot interface, may facilitate positioning of the components relative to the seal retrieval adapter 112. In various embodiments, one or more components may be coupled together. For example, the sleeve 308 may be threaded to the seal retrieval adapter 112 via rotation driven by the retrieval tubular 302. Upon coupling the sleeve 308 to the seal retrieval adapter 112, a vertical constraint and anti-rotation features (such as the j-slot noted above) may be engaged. Partial rotation in the opposite direction would disengage this anti-rotation feature and allow relative vertical movement.

Figure 4:
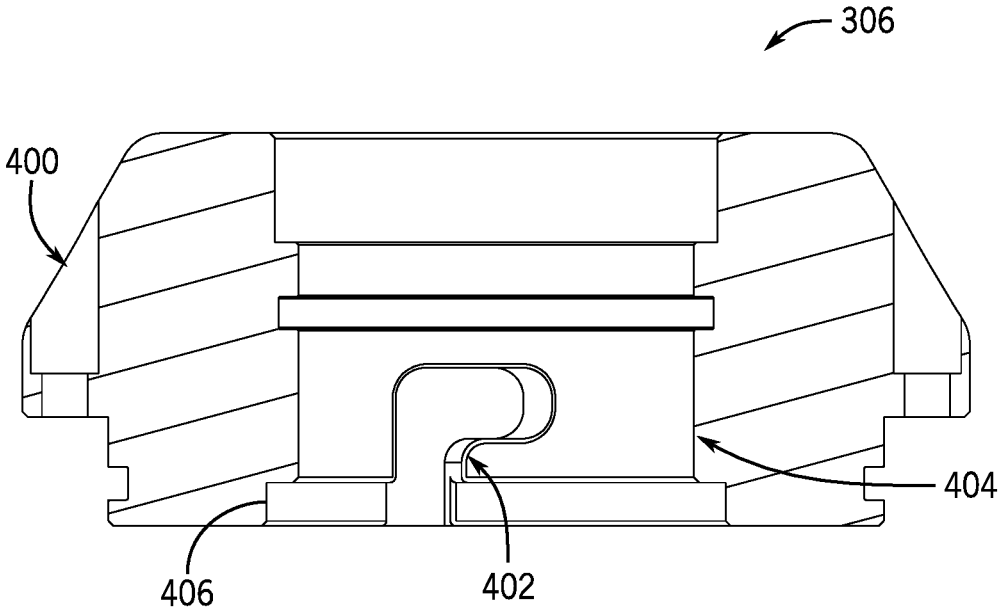
FIG. 4 is a cross-sectional view of an embodiment of a sleeve cap of a wellbore system, in accordance with embodiments of the present disclosure.

FIG. 4 is a cross-sectional view of an embodiment of the sleeve cap 306 illustrating apertures 400 for receiving fasteners for coupling to the sleeve 308 along with a j-slot 402 for coupling to the retrieval tubular 302. As noted above, these features are shown for illustrative purposes and alternative configurations may be utilized in various embodiments. For example, the apertures 400 may be replaced, or may be used along with, one or more sets of fasteners, such as threads, that may be utilized to engage the sleeve 308. For example, one or more sets of threads may be arranged along an external location of the sleeve cap 306 to enable the sleeve cap 306 to thread into the sleeve 308. In at least one embodiment, the threads may be an opposite direction as a rotational force utilized to engage the j-slot 402. In this manner, engaging or disengaging the sleeve cap 306 with the tool and/or the sleeve 308 may be independent of one another, thereby reducing a likelihood that rotational forces for one operation will loosen/overtighten/otherwise affect the other operation.

Various embodiments illustrate a variable bore diameter 404 for the sleeve cap 306, which may facilitate installation of one or more seals, among other options. In at least one embodiment, a lower groove 406 facilitate flow of fluid from the bore 316 along the flow path 320. That is, fluid may enter into the lower groove 406 at a location where a tubular diameter is less than a groove diameter. Such an arrangement permits a fluid flow to an area along the uphole side 322 of the piston head 324, which may facilitate with driving or otherwise moving the stem 310.

Figure 5:
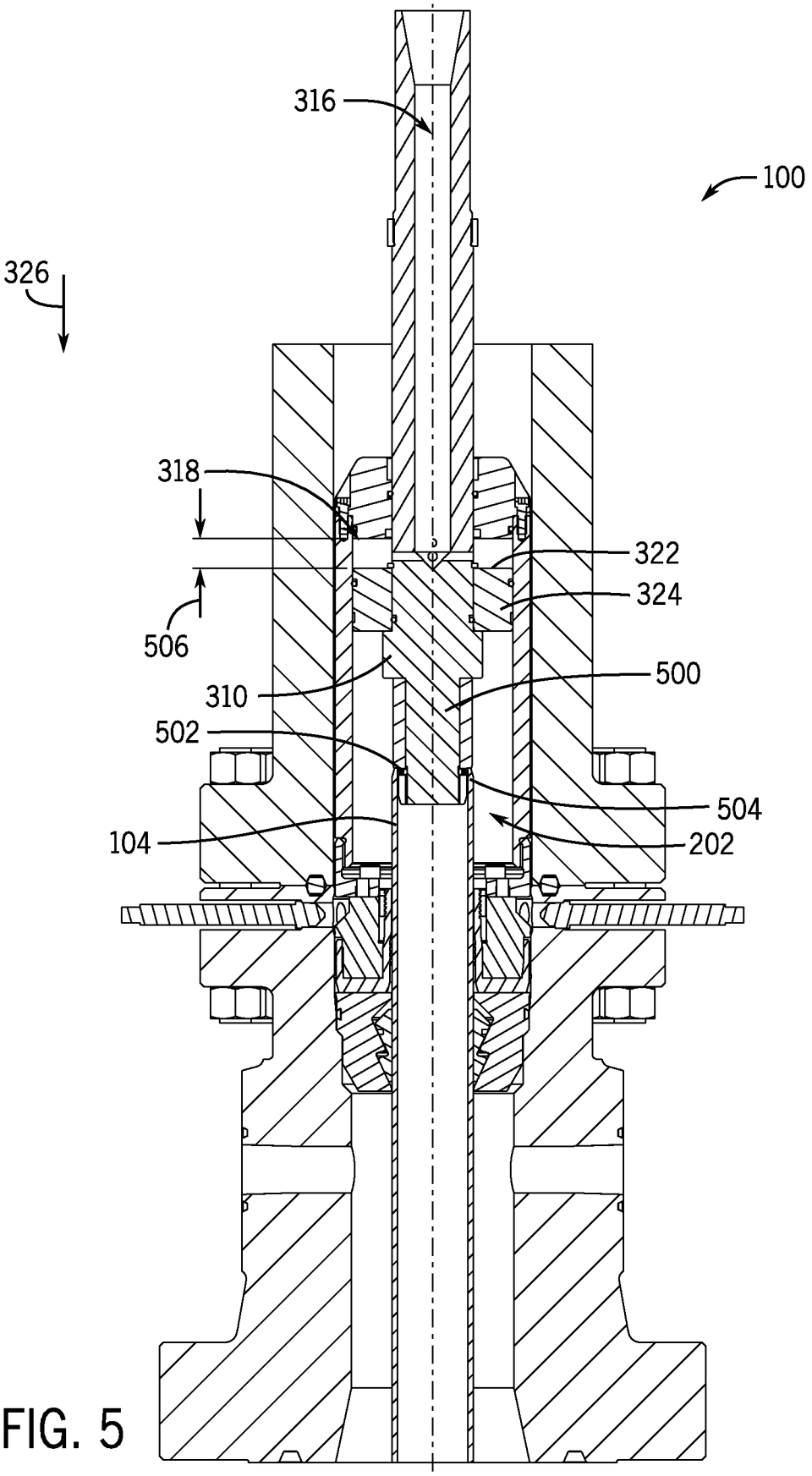
FIG. 5 is a cross-sectional view of an embodiment of a wellbore system, in accordance with embodiments of the present disclosure.

FIG. 5 is a cross-sectional view of an embodiment of the wellbore system 100 illustrating an operational position where a fluid pressure is introduced into the cavity 318 via the bore 316. For example, pressure may be applied to stroke the tool such that there is full engagement between the stem 310 and the casing section 104. The fluid pressure may apply a force to the uphole side 322 of the piston head 324, which drives the stem 310 in the downward direction 326 to engage the casing section 104. As shown in FIG. 5, an end 500 of the stem 310 has extended into the casing section 104, as opposed to the configuration in FIG. 3, where the end 500 is shown at an opening of the casing section 104. In this configuration, a load area 502 is positioned over a platform 504 formed at the end 500. Accordingly, a downward force applied via the piston 314 is transmitted to the casing section 104.

As shown, the inclusion of the fluid into the cavity 318 drives the piston head 324 away from the sleeve cap 306 by distance 506. When compared to FIG. 3, it can be seen that the distance 506 is larger than before entry of fluid into the cavity 318, thereby illustrating the movement of the stem 310 in the direction 326. It should be appreciated that the distance 506 may vary based on a variety of factors, such as a location of the stud end 202 of the casing section 104.

In this example, it can be seen that other components of the retrieval tool and associated assembly are substantially stationary during movement of the stem 310. By way of example only, the sleeve 308 continues to bear against the retrieval adapter 112 such that any forces applied to the sleeve 308 (e.g., such to the fluid pressure within the cavity 318) may be applied to the seal assembly 110, among other components. Additionally, the casing section 104 remains fixed into position via the slip hanger 108 and can, as a result, receive the end 500.

Figure 6:
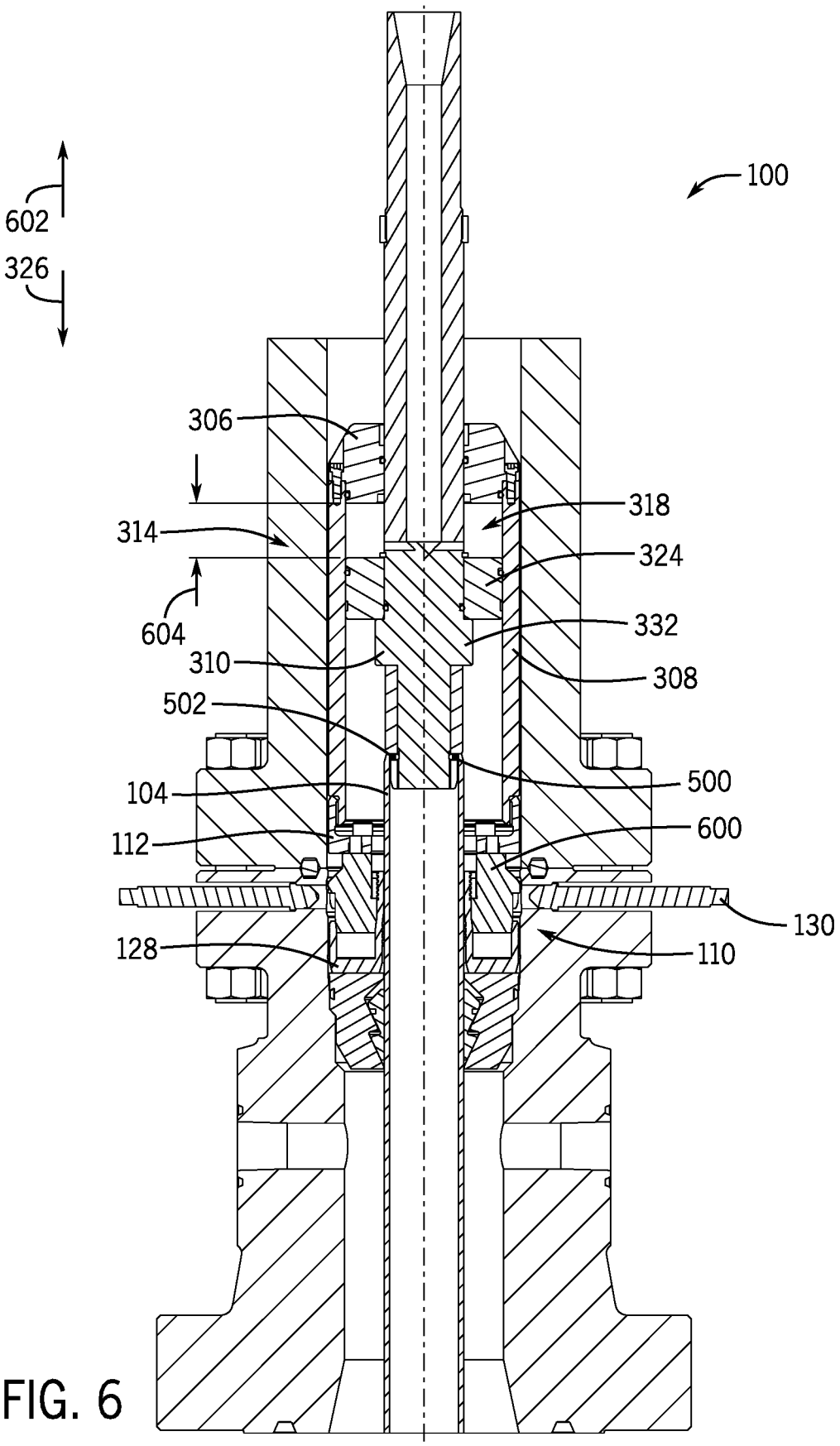
FIG. 6 is a cross-sectional view of an embodiment of a wellbore system, in accordance with embodiments of the present disclosure.

FIG. 6 is a cross-sectional view of an embodiment of the wellbore system 100 illustrating movement of an annular packoff energizing ring 600 associated with the seal 110 in an upward direction 602 (e.g., uphole direction) due to the force applied by the piston 314. Removal of the annular packoff energizing ring 600 may de-energize the seal 110. In this example, the piston head 324 has moved in the downward direction 326, for example when compared to the position in FIGS. 3 and 5. That is, a distance 604 is greater than the distance 506. This movement of the piston head 324 is translated to the casing section 104 via the connection between the stem 310 and the casing section 104. Fluid pressure builds in the cavity 318 and is restricted from exiting via the sleeve cap 306, which is coupled to the sleeve 308. As a result, an upward force is generated by the sleeve 308, which is applied to the seal retrieval adapter 112, which as noted above, is coupled to the seal 110 and/or to one or more components of the seal 110. Accordingly, the piston pressure is transmitted to the seal 110 to facilitate removal.

As shown in this example, the seal fasteners 130 have been removed and/or deactivated to permit movement of the energizing ring 600. This movement is in the upward direction 602, which removes the forces that drive the legs of the sealing element 128 radially inward/outward from the energizing ring 600 and against the casing section 104 and the tubing spool 102, respectively. As a result, the sealing element 128 may be deenergized such that removal is now permitted. It should be appreciated that the increased diameter portion 332 may, at least in part, restrict or block continued downward movement of the piston head 324. Accordingly, the force of the fluid within the cavity 318 may react against the uphole side 322 after a certain amount of movement such that the end 500 is fully inserted. In this manner, the load area 502 is utilized to pivot or otherwise drive the upward movement of the sleeve 308, which removes the energizing ring 600 to permit removal of the seal 110.

Figure 7:
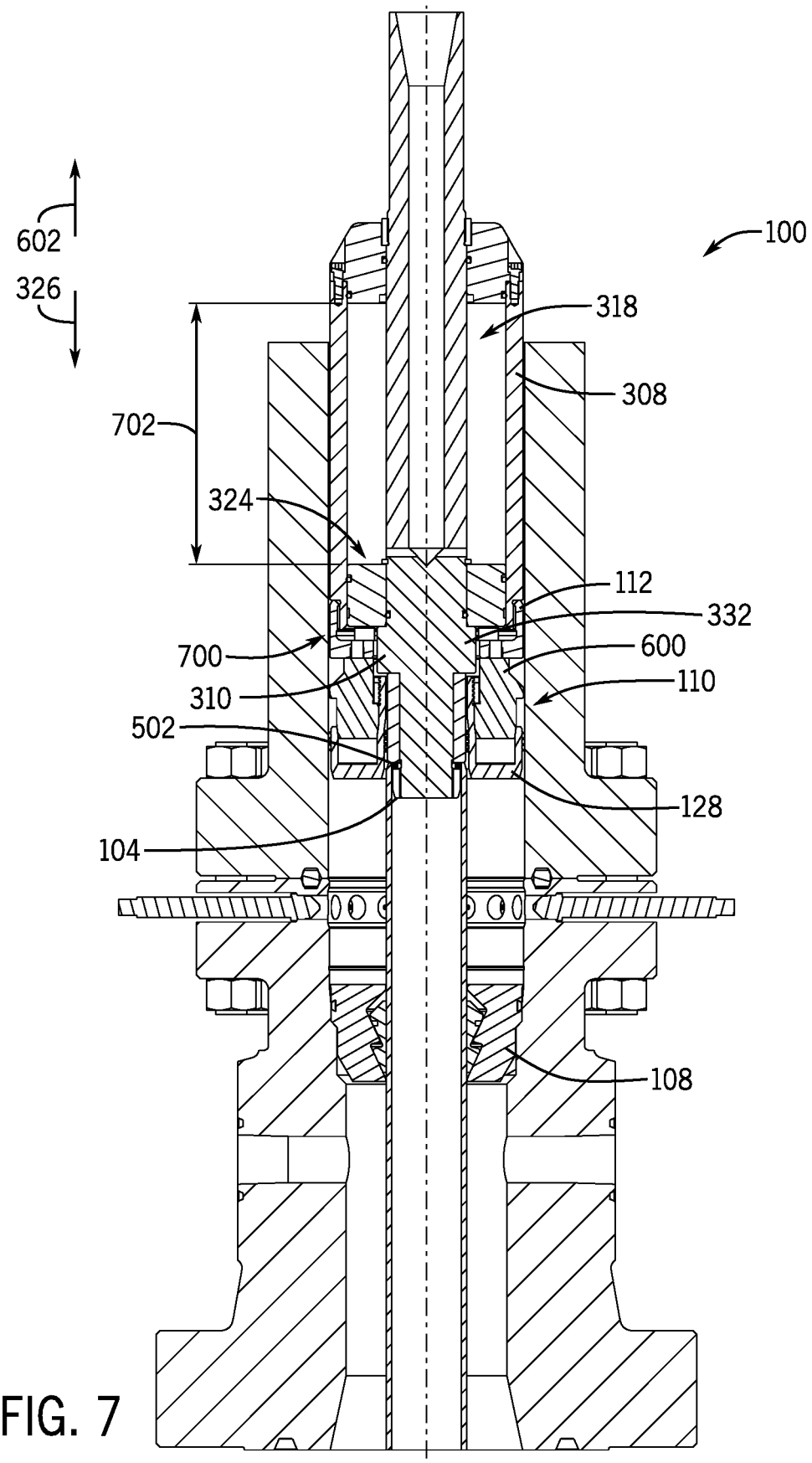
FIG. 7 is a cross-sectional view of an embodiment of a wellbore system, in accordance with embodiments of the present disclosure.

FIG. 7 is a cross-sectional view of an embodiment of the wellbore system 100 illustrating removal of the seal 110 via the pressure within the cavity 318. In this example, the coupling between the sleeve 308 and the seal retrieval adapter 112 is used to apply a force in the upward direction 602 to pull the seal 110 upwards and away from the slip hanger 108. As shown in FIG. 7, the piston head 324 is at a bottom 700 of the cavity 318, but it should be appreciated that sufficient force may be generated before the piston head 324 is at the bottom 700. Accordingly, embodiments of the present disclosure engagement transmission of removal forces to the seal 110 by using the casing section 104 as a reaction point.

In this example, the distance 702 is greater than the respective distances shown in FIGS. 3, 5, and 6. As shown, initially, movement of the stem 310 is blocked until sufficient pressure is provided to deenergize the sealing element 128. Thereafter, the stem 310 is driven in the downward direction 326 such that the increased diameter portion 332 may contact or otherwise engage the load area 502. However, it should be appreciated that such an insertion or downward movement is by way of example only and, in other embodiments, the stem 310 may not move as far as shown in FIG. 7. Further illustrated, in this example, is the simultaneous or near-simultaneous removal of both the energizing ring 600 and the sealing element 128. In one or more embodiments, one or more catches, latches, rings, or the like may be provided to couple the elements together. In other embodiments, at least partial deformation may lead to the joining of the components. In various other embodiments, one or more portions of the retrieval adapter 112 may be coupled to one or more of the energizing ring 600 and/or the sealing element 128, among other features.

Upon removal the seal 110, the slip hanger 108 maintains the position of the casing section 104. For example, the retrieval tool 300 may be tripped out of the wellbore such that the step 310 disengages from the casing section 104. In various other embodiments, the stem adapter 312 may secure or otherwise engage the casing section 104 for further wellbore operations.

It should be appreciated that systems and methods of the present disclosure may utilize one or more additional and/or alternative features to engage the casing section 104. For example, a second set of slips, oriented in an opposite direction with respect to the slip hanger 108, may be installed to grip the internal or external diameter of the casing section 104. As a result, downward fluid pressure would be transmitted to the casing section 104 via the slips. Furthermore, in various embodiments, clamps or other coupling devices may also be utilized to provide a reaction point at the casing section 104.

Figure 8:
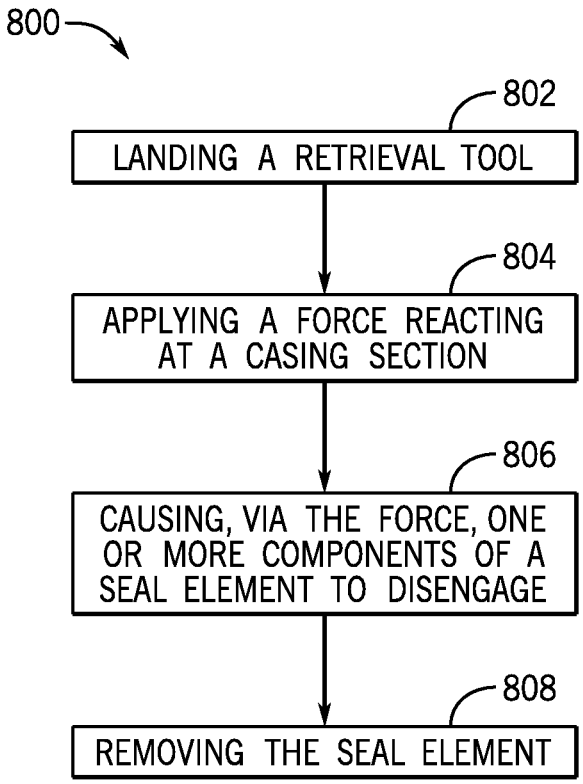
FIG. 8 is a flow chart of an embodiment of a method for removing a downhole component, in accordance with embodiments of the present disclosure.

FIG. 8 is a flow chart of a method 800 for removing a downhole component, such as a seal. It should be appreciated that steps of methods described herein may be performed in any order, or in parallel, unless otherwise specifically stated. Furthermore, there may be more or fewer steps. In at least one embodiment, a method may include securing an adapter to a seal. The method may also include landing a retrieval tool on at least one of the adapter or a casing section 802. In at least one embodiment, the method may include applying a force at a reaction point incorporating a casing section 804. In various embodiments, the force is sufficient to disengage or otherwise decouple the component 806. In the example provide above, the force de-energizes a seal by removing an energizing ring. In at least one embodiment, the component is them removed from the wellbore, for example, through an uphole component such as a BOP 808.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A wellbore system, comprising:

an adapter configured to couple to a downhole component;

a retrieval tubular, having a bore extending therethrough;

a piston assembly coupled to the retrieval tubular, wherein the bore is in fluid communication with a cavity of the piston assembly;

a stem configured to couple to a casing section, the casing section being supported by a hanger; and a sleeve forming at least a portion of the piston assembly, the sleeve configured to couple to the adapter such that, responsive to a force applied by a piston at the casing section, the sleeve applies an upward force to the adapter.

2. The wellbore system of claim 1, wherein the downhole component is a seal assembly.

3. The wellbore system of claim 1, further comprising:

a cap, coupled to the sleeve, and forming at least a portion of the cavity.

4. The wellbore system of claim 3, further comprising:

an anti-rotation feature formed in the cap, the anti-rotation feature configured to permit coupling between the adapter and the sleeve when engaged, and to permit axial movement of the stem when disengaged.

5. The wellbore system of claim 1, wherein the sleeve is threadingly coupled to the adapter.

6. The wellbore system of claim 1, further comprising:

a stem adapter positioned about the stem, the stem adapter configured to adjust an outer diameter of the stem based at least in part on a diameter of the casing section.

7. The wellbore system of claim 1, wherein the adapter is coupled to at least an energizing ring, the force deenergizing a sealing element associated with the energizing ring.

8. The wellbore system of claim 1, wherein the force reacts against the casing section and not against a housing.

9. A retrieval assembly, comprising:

a retrieval tubular having a stem at an end, a bore extending through at least a portion of the retrieval tubular forming a flow path to a location external of the retrieval tubular;

a piston assembly, the piston assembly having a sleeve and a cap that form, at least in part, a cavity, the sleeve adapted to couple to a retrieval adapter associated with a downhole component, wherein a piston head is movable within the cavity responsive to a fluid pressure introduced via the flow path;

wherein the flow path directs the fluid pressure to an uphole side of the piston head such that the stem is driven in a downhole direction to engage a casing section, the stem applying a force at the casing section such that the sleeve is driven in an uphole direction to drive movement of the retrieval adapter in the uphole direction to disengage at least a portion of the downhole component.

10. The retrieval assembly of claim 9, wherein the cap includes one or more anti-rotation features to permit coupling between the retrieval adapter and the sleeve when engaged, and to permit axial movement of the stem when disengaged.

11. The retrieval assembly of claim 9, wherein the retrieval adapter is coupled to the downhole component before the stem is arranged within a wellbore.

12. The retrieval assembly of claim 9, wherein the cap includes a lower groove to direct the fluid pressure into the cavity.

13. The retrieval assembly of claim 9, wherein the stem is driven into the casing section to a first position associated with an engaged downhole component, to a second position associated with a disengaged downhole component, and to a third position associated with a removed downhole component, wherein the first position is different from the second position and the second position is different from the third position.

14. The retrieval assembly of claim 9, further comprising:

a stem adapter positioned about the stem, the stem adapter configured to adjust an outer diameter of the stem based at least in part on a diameter of the casing section.

15. The retrieval assembly of claim 9, wherein the cap is coupled to the sleeve via one or more of fasteners or threads.

16. The retrieval assembly of claim 9, wherein the stem includes an increased diameter portion forming a shoulder, the piston head engaging the shoulder to transmit the force to the stem.

17. A method for removing a downhole component, comprising:

coupling, to a downhole component, an adapter;

coupling, to the adapter, a sleeve of a removal tool;

coupling, to a casing section, a stem of the removal tool;

generating a downward force at the casing section, wherein the downward force is generated via a piston assembly; and responsive to the downward force, deactivating the downhole component.

18. The method of claim 17, wherein the downhole component is a seal assembly.

19. The method of claim 17, further comprising:

removing the downhole component through a surface pressure control device.

* * * * *